US011804680B2

(12) United States Patent
Collins et al.

(10) Patent No.: US 11,804,680 B2
(45) Date of Patent: Oct. 31, 2023

(54) RF CONNECTORS WITH DISPENSABLE AND FORMABLE INSULATIVE MATERIALS AND RELATED METHODS

(71) Applicant: CORNING OPTICAL COMMUNICATIONS RF LLC, Glendale, AZ (US)

(72) Inventors: Terry George Collins, Litchfield Park, AZ (US); Charlotte Diane Milia, Chandler, AZ (US); Casey Roy Stein, Surprise, AZ (US)

(73) Assignee: CORNING OPTICAL COMMUNICATIONS RF LLC, Glendale, AZ (US)

( * ) Notice: Subject to any disclaimer, the term of this patent is extended or adjusted under 35 U.S.C. 154(b) by 28 days.

(21) Appl. No.: 17/488,091

(22) Filed: Sep. 28, 2021

(65) Prior Publication Data

US 2022/0102924 A1 Mar. 31, 2022

Related U.S. Application Data

(60) Provisional application No. 63/085,866, filed on Sep. 30, 2020.

(51) Int. Cl.

| | |
|---|---|
| ***H01R 24/40*** | (2011.01) |
| ***H01R 13/405*** | (2006.01) |
| ***H01R 43/20*** | (2006.01) |
| ***H01R 4/58*** | (2006.01) |

(52) U.S. Cl.

CPC ..... *H01R 24/40* (2013.01); *H01R 4/58* (2013.01); *H01R 13/405* (2013.01); *H01R 43/20* (2013.01)

(58) Field of Classification Search

CPC ..... H01R 4/58; H01R 13/03; H01R 13/405; H01R 13/521; H01R 13/5216; H01R 24/38; H01R 24/40; H01R 24/44; H01R 43/20; H01R 43/24

See application file for complete search history.

(56) References Cited

U.S. PATENT DOCUMENTS 4,714,432 A 12/1987 Huggins
4,841,101 A * 6/1989 Pollock ..... H01B 17/305 403/30
4,913,673 A 4/1990 Kobler
(Continued)

FOREIGN PATENT DOCUMENTS

WO 2019/104010 A1 5/2019

OTHER PUBLICATIONS

Tsai et al; "Low Dielectric Polyimide/Poly(Silsesquioxane)-Like Nanocomposite Material" Polymer, 42 (2001); pp. 4197-4207.

*Primary Examiner* — Oscar C Jimenez
(74) *Attorney, Agent, or Firm* — Tamika A. Crawl-Bey

(57) ABSTRACT

A method for making an RF connector having an outer conductor and an inner conductor includes the steps of plating the outer conductor and the inner conductor of the RF connector with at least one corrosion-resistant metallic material; dispensing and/or injecting a material comprising an epoxy phenol novolac based resin. in a volume between the outer conductor and the inner conductor of the connector; heating the RF connector with the injected material to a temperature between about 150° C. to about 380° C. in a substantially dry nitrogen-based environment; and allowing the RF connector to cool.

20 Claims, 10 Drawing Sheets

(56) References Cited

U.S. PATENT DOCUMENTS

| | | | | |
|---|---|---|---|---|
| 5,436,994 | A | 7/1995 | Ott et al. | |
| 5,535,512 | A | 7/1996 | Armogan | |
| 5,563,562 | A | 10/1996 | Szwec | |
| 5,879,610 | A * | 3/1999 | Beinhaur | B29C 45/14639 264/296 |
| 6,037,539 | A | 3/2000 | Kilgo et al. | |
| 7,011,529 | B2 * | 3/2006 | Oldfield | H01R 24/44 439/63 |
| 7,144,274 | B2 * | 12/2006 | Taylor | H01R 24/50 439/586 |
| 8,231,406 | B2 | 7/2012 | Burris et al. | |
| 8,378,239 | B2 | 2/2013 | Lakner et al. | |
| 9,130,328 | B1 | 9/2015 | Huang et al. | |
| 9,768,543 | B2 | 9/2017 | Taylor | |
| 10,723,648 | B2 * | 7/2020 | De Deken | C03C 27/044 |
| 2002/0132898 | A1 * | 9/2002 | Takaya | H01B 3/442 524/543 |
| 2007/0074896 | A1 * | 4/2007 | Tanaka | C08G 59/4042 174/259 |
| 2007/0231581 | A1 * | 10/2007 | Lin | H05K 3/4676 428/413 |
| 2013/0189513 | A1 * | 7/2013 | Dreezen | C09J 9/02 252/514 |
| 2017/0162958 | A1 | 6/2017 | Laighton et al. | |
| 2019/0109419 | A1 | 4/2019 | Garcia et al. | |
| 2019/0165536 | A1 * | 5/2019 | Dawes | H01R 43/24 |

* cited by examiner

RF CONNECTORS WITH DISPENSABLE AND FORMABLE INSULATIVE MATERIALS AND RELATED METHODS

CROSS-REFERENCE TO RELATED APPLICATION

This application claims the benefit of priority under 35 U.S.C. § 119 of U.S. Provisional Application Ser. No. 63/085,866, filed Sep. 30, 2020, the content of which is relied upon and incorporated herein by reference in its entirety.

BACKGROUND

The disclosure relates generally to radio frequency (RF) connectors and, more particularly, to connectors and connector assemblies, having formable insulative materials. Methods related to radio frequency (RF) connectors having formable insulative materials are also disclosed herein.

Currently, in connector assemblies, insulators and dielectrics are made of various types of non-conductive insulative materials. These materials include plastic, glass ceramic and epoxy materials. The main purpose of these types of insulative materials is to electrically isolate connector components from one another. In some cases, however, a secondary purpose of insulators and dielectrics is to hermetically seal the connector.

When used in a Radio Frequency (RF) connector; insulative materials provide a consistent and favorable dielectric constant to maintain specific impedance (25-300 ohms, more specifically 50-75 ohms). A dielectric constant of 1-10 is generally required, but a dielectric constant ranging from about 2 to about 5 is preferred. It is important that the dielectric constant be consistent over a wide range of operating frequencies (e.g. DC—140 GHz). Also, the dielectric constant should be low loss with a loss tangent less than 0.01.

Most connectors require some level of surface treatment, primarily nickel and/or gold plating, to ensure that connectors will not corrode. Corrosion can lead to changes in its electrical performance. Typically, plated parts cannot be subjected to high temperatures (450° C.) for a period of time generally ranging from about 3-5 minutes. For high-temperature applications, such as those having temperatures ranging from 165° C. to 400° C., glass ceramic materials are primarily used. However, current process temperatures for glass ceramics ranges from about 800° C. to about 1050° C. Thus, the process temperatures often exceeds acceptable levels for plated connector parts.

Another issue with using glass and ceramic dielectric materials is that glass pre-forms are typically required to be stocked for every size dielectric needed. New pre-forms are expensive and often have long lead times.

Consequently, there are several unresolved needs for improved insulative materials used in connector assemblies. There is a particular needs for methods of manufacturing insulators and dielectrics with the ability to withstand processes used in high temperature and hermetically seal environments, while employing materials and manufacturing processes which allow for pre-plated components.

SUMMARY

In accordance with certain embodiments of the present disclosure, one objective is to replace glass ceramics with at least one material, which can be processed at much lower temperatures (150° C.-380° C., vs. 800° C.-1050° C.), allowing for pre-plated parts to be processed.

In accordance with this objective, one aspect of the disclosure relates to a method for manufacturing an RF connector, which may or may not be coaxial, having an outer conductor and an inner conductor. The method includes the steps of plating the outer conductor and the inner conductor of the RF connector with at least one corrosion-resistant material, positioning the inner conductor and the outer conductor into a fixture assembly, dispensing at least one formable insulative material (e.g. via an automated cnc dispensing system) into a volume between the inner conductor and the outer conductor, and heating the RF connector and the dispensed insulative material to a temperature between a pre-determined temperature range. The step of dispensing is preferably achieved using jetting technology or syringe technology. Moreover, during the step of positioning, a portion of the inner conductor can be positioned within a first non-metallic fixture tier and a second non-metallic fixture tier and a portion of the outer conductor can be positioned within the first non-metallic fixture tier and the second non-metallic fixture tier.

Another method of manufacturing a connector having an outer conductor and an inner conductor includes plating the outer conductor and the inner conductor of the RF connector with a corrosion-resistant metallic material; positioning the inner conductor and the outer conductor such that a volume is formed between the inner conductor and the outer conductor injecting a material comprising an epoxy phenol novolac based resin into the volume formed between the outer conductor and the inner conductor, wherein defined in the outer conductor is at least one retention element; substantially filling the at least one retention element with the epoxy phenol novolac based resin during injection of the material; allowing air bubbles to escape from the outer conductor after the material is injected into the volume and the material is substantially filled into the retention groove; heating the RF connector with the injected material to a temperature between about 150° C. to about 380° C.; and allowing the RF connector to cool.

The insulative material comprises an epoxy phenol novolac resin, which is heated to a temperature between about 150° C. to about 380° C. The epoxy phenol novolac based resin preferably comprises a imidazole catalyst which is thermally cured.

Heating of the insulative material in the RF connector preferably occurs in a substantially dry nitrogen-based environment. Heating the RF connector with the dispensed material can further include heating the RF connector by an oven that uses a nitrogen and partial-vacuum atmosphere. After heating, the RF connector is allowed to cool.

Yet another embodiment of the disclosure is directed to a connector, manufactured by a method including the steps of pre-plating the outer conductor and the inner conductor of the connector with a corrosion-resistant material, e.g. a corrosion-resistant metallic materials, injecting a material comprising epoxy phenol novolac material in a volume between the outer conductor and the inner conductor of the connector, heating the connector with the injected material to a temperature between about 150° C. to about 380° C. in a substantially dry nitrogen-based environment, and allowing the connector to cool.

Additional features and advantages will be set forth in the detailed description which follows, and in part will be readily apparent to those skilled in the art from the description or recognized by practicing the embodiments as described in the written description and claims hereof, as well as the appended drawings.

It is to be understood that both the foregoing general description and the following detailed description are merely exemplary, and are intended to provide an overview or framework to understand the nature and character of the claims.

The accompanying drawings are included to provide a further understanding, and are incorporated in and constitute a part of this specification. The drawings illustrate one or more embodiments, and together with the description serve to explain principles and operation of the various embodiments.

DETAILED DESCRIPTION

Figure 1:
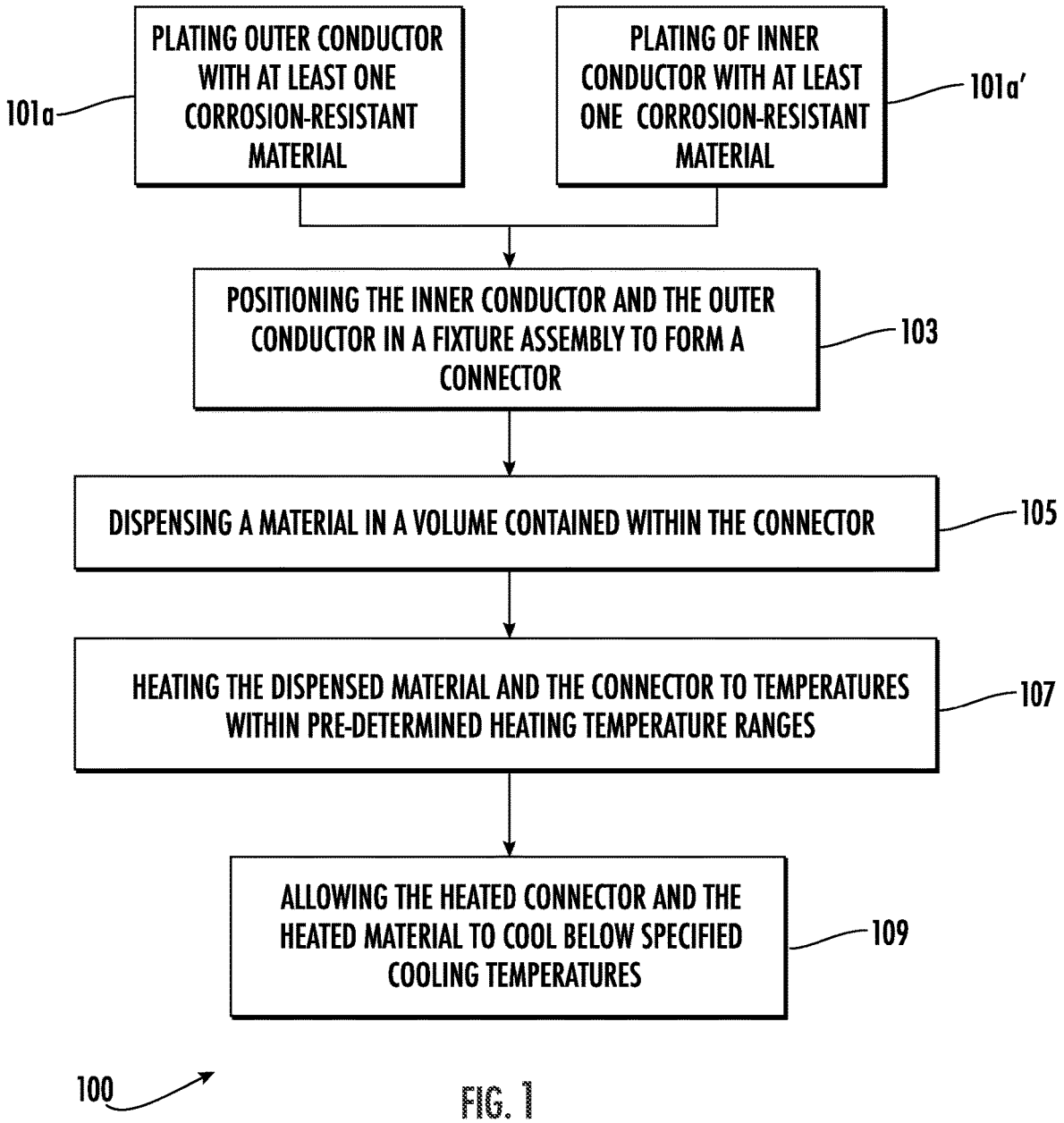
FIG. 1 illustrates an exemplary method of manufacturing an RF connector in accordance with embodiments disclosed herein.

Various exemplary embodiments of the disclosure will now be described with particular reference to the drawings. Exemplary embodiments of the present disclosure may take on various modifications and alterations without departing from the spirit and scope of the disclosure. Accordingly, it is to be understood that the embodiments of the present disclosure are not to be limited to the following described exemplary embodiments, but are to be controlled by the features and limitations set forth in the claims and any equivalents thereof.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise.

Spatially related terms, including but not limited to, "lower," "upper," "beneath," "below," "above," and "on top," if used herein, are utilized for ease of description to describe spatial relationships of an element(s) to another. Such spatially related terms encompass different orientations of the device in use or operation in addition to the particular orientations depicted in the figures and described herein. For example, if an object depicted in the figures is turned over or flipped over, portions previously described as below or beneath other elements would then be above those other elements.

Cartesian coordinates are used in some of the Figures for reference and are not intended to be limiting as to direction or orientation.

For purposes of description herein, the terms "upper," "lower," "right," "left," "rear," "front," "vertical," "horizontal," "top," "bottom," "side," and derivatives thereof, shall relate to the disclosure as oriented with respect to the Cartesian coordinates in the corresponding Figure, unless stated otherwise. However, it is to be understood that the disclosure may assume various alternative orientations, except where expressly specified to the contrary.

For the purposes of describing and defining the subject matter of the disclosure it is noted that the terms "substantially" and "generally" may be utilized herein to represent the inherent degree of uncertainty that may be attributed to any quantitative comparison, value, measurement, or other representation.

Processes/methods consistent with the disclosed embodiments herein relate to making or manufacturing RF connectors that facilitate the use of dispensable, formable, and insulative materials, which can be more flexibly formed and/or used at lower temperatures compared to traditional insulative materials used in RF connectors. Manufacturing RF connectors according to these methods can particularly avoid damage to plated components, which typically occur at high temperatures during prior art methods of connector manufacture. In addition, the insulative materials used in such processes/methods have performance characteristics that are usually associated with glass and ceramic dielectrics.

Processes/methods consistent with the disclosed embodiments involve the use of a dielectric comprising a low-dielectric epoxy phenol novolac based resin. This material is advantageous because its dielectric properties are similar to glass or ceramics and the material is capable of being processed at temperatures which will not deteriorate plating of connector components. Percentages of the epoxy phenol novolac based resin in the connector can range from about 75% to about 100%, about 50% to about 100%, about 25% to about 100%, about 15% to about 100%, about 10% to about 100%, and about 5% to about 100%. The remaining volume percentage of the material can include another proprietary resin material and/or another resin having similar dielectric properties. Processing temperatures for prior art processes/methods typically range from about 800° C. to about 1100° C.

In accordance with one embodiment, a method for manufacturing an RF connector includes the steps of plating an outer conductor with at least one corrosion resistant material 101*a*, plating an inner conductor with at least one corrosion resistant material 101*a*', positioning the plated inner conductor and the plated outer conductor in a fixture assembly 103 to form a connector such that a volume is created between the inner conductor and the outer conductor, dispensing a material in the volume contained within the connector 105. After the material is dispensed in the volume, another step in the method includes heating the dispensed material and heating the connector to temperatures within pre-determined temperature ranges 107, and allowing the heated connector and the heated material to cool below specified cooling temperatures 109, specifically to a cooled dispensed material temperature and a cooled connector temperature.

Additional steps include injecting a material comprising an epoxy resin in a volume between the outer conductor and the inner conductor of the connector, heating the connector with the injected material to a temperature between about 150° C. to about 380° C., and allowing the connector to cool to a temperature of about 20° C.

Indeed, processes and methods consistent with the disclosed embodiments are particularly useful when different sizes/shapes of dielectric material are present, since the dielectric materials used are injectable/flowable/formable under relatively low heat when compared with glass or ceramic components.

Figure 2:
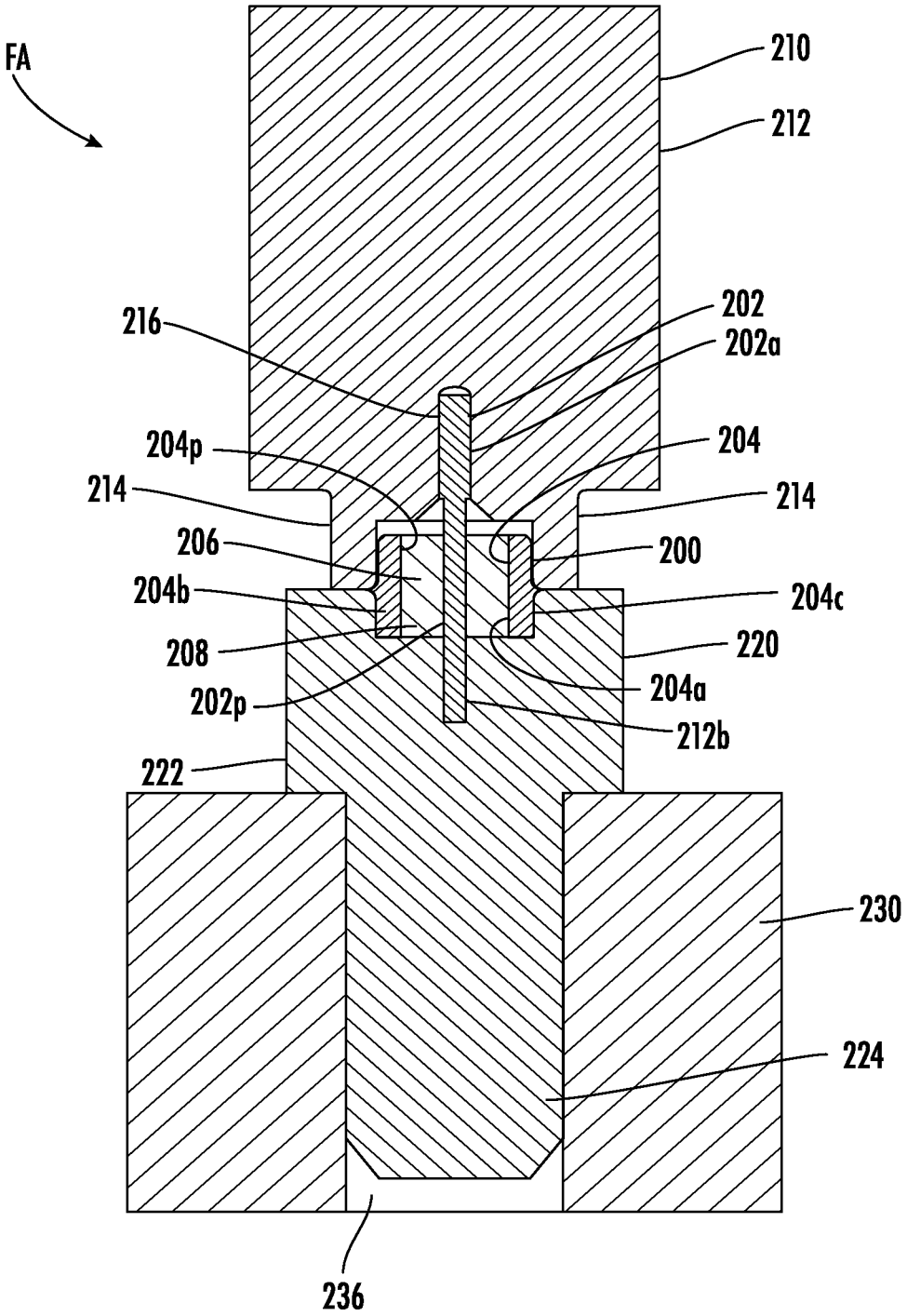
FIG. 2 is a cross-sectional view of an exemplary RF connector positioned within a fixture assembly used in an exemplary method for manufacturing the RF connector, in accordance with embodiments disclosed herein.

FIG. 2 is a cross-sectional view of an exemplary RF connector 200 positioned within a fixture assembly FA used in a method for manufacturing the RF connector. The RF connector 200 is exemplary and can include additional elements or different configurations, including those described with respect to FIGS. 3-10. The RF connector 200 includes an inner conductor 202 and an outer conductor 204. The connector 200 is shown with the dispensed insulative material 206 contained in a volume 208 contained within the connector 200. The outer conductor 204 is configured to surround the insulative material 206 and the insulative material 206 is configured to surround the inner conductor 202. In this exemplary configuration the outer conductor 204 is cylindrical and includes an inner diameter 204*a*, an outer diameter 204*b*, and a length 204*c*. The inner conductor 202 has a center conducting pin configuration with pin portions 202*a*, 202*b*. The insulative material is dispensable and flowable. Thus the insulative material is configured to fill and complement profiles of the connector, as will be described particularly with reference to FIGS. 4, 6, and 9. For the connector 200, as particularly shown in FIG. 2, the insulative material also takes a cylindrical form, which complements the inner profile 204*p* of the outer conductor 204 and the outer profile 202*p* of the inner conductor 202. The profiles of the inner conductor and the outer conductor are configured to act as retention elements to secure the insulative material in the connectors disclosed herein.

Accordingly, the fixture assembly FA shown is exemplary as additional elements may be included and the configuration of the fixture elements may differ. However, elements included in the fixture assembly are such that the fixture assembly is configured to dispense and/or inject the insulative material and form an RF connector.

In this exemplary embodiment, the fixture assembly FA includes an upper fixture block 210, a middle fixture block 220, and a lower fixture block 230. The upper fixture block 210 has a stepped configuration with two tiers 212, 214. The first upper fixture tier 212 includes an inner conductor opening 216 configured to receive a portion of the inner conductor 202. And, the second upper fixture tier 214 includes an outer conductor opening 218 configured to hold a portion of the outer conductor 204. The middle fixture block 220 also includes two tiers 222, 224. The first lower fixture tier 222 includes a connector holding area 226 configured to receive a portion of the inner conductor 202 and a portion of the outer conductor 204. The middle fixture block 220 is also configured to but against the second upper fixture tier 214 of the upper fixture block 210 and lower fixture block 230. The lower fixture block includes a thru-hole 236 configured to receive the second lower fixture tier 224.

The upper fixture block 210 and the middle fixture block 220 are preferably manufactured from one or more materials having non-stick properties such that a connector can be removed from the fixture assembly FA without significant effort. Such materials can include polytetrafluorethylene, for example. In preferred configurations of the fixture assembly, the lower fixture block 230 comprises one or more metallic materials.

FIGS. 3-10 provide views of different embodiments of connectors and connector assembles, including elements that may be manufactured using the presently-disclosed processes/methods.

Figure 3:
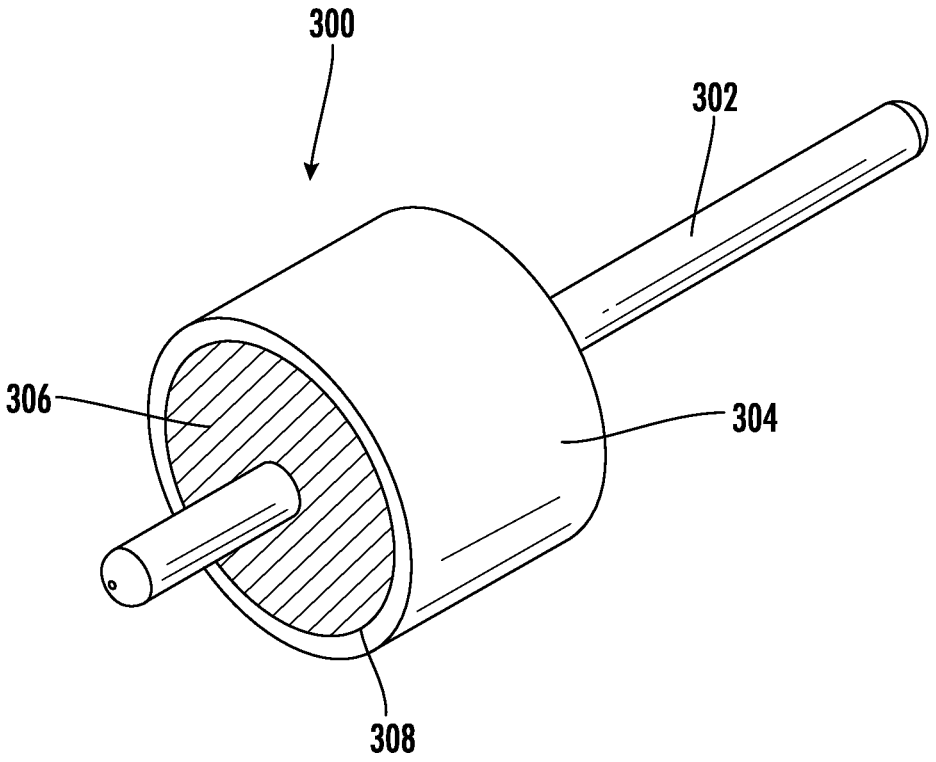
FIG. 3 is an isometric view of a feed-through connector in accordance with embodiments disclosed herein.
Figure 4:
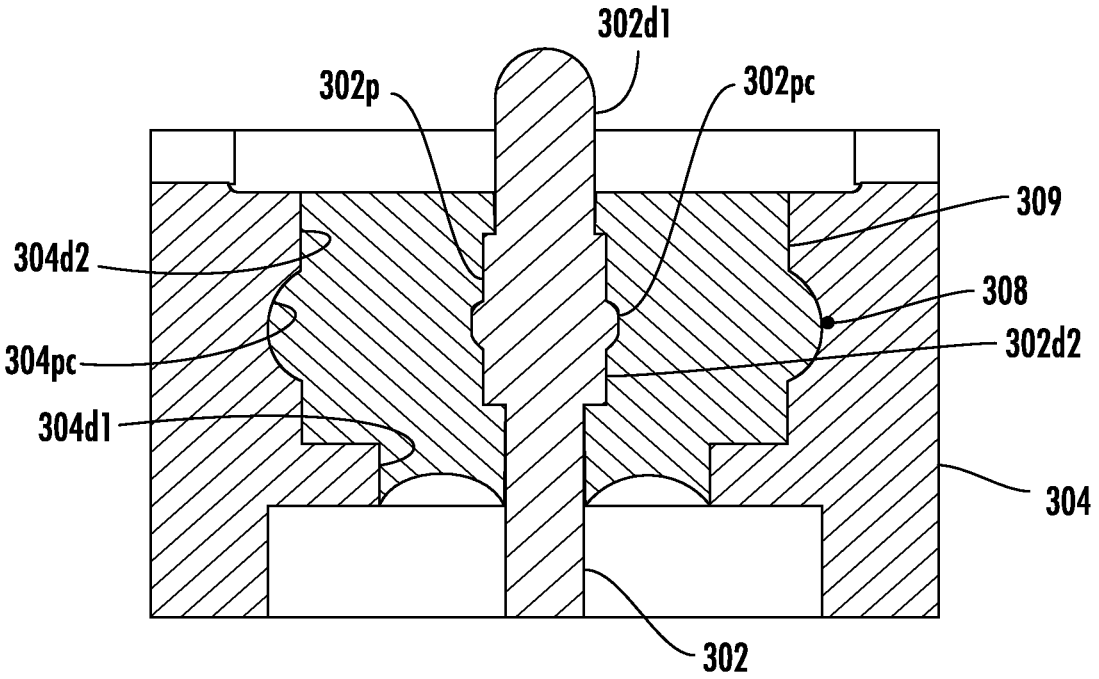
FIG. 4 is a cross-sectional view of the connector shown in FIG. 4 in accordance with embodiments disclosed herein.

FIGS. 3 and 4 illustrate an exemplary feed-through connector 300, which includes an inner conductor 302, an outer conductor 304, and a insulative material 306, which has been formed in the volume 308 between the inner conductor 302 and the outer conductor 304. The insulative material 306 is formed within the volume 308 such that the insulative material conforms to the inner profile 304*p* of the outer conductor 304 and the outer profile 302*p* of the inner conductor 302. The inner profile 304*p* of the outer conductor 404 has a stepped configuration and includes a radiused profile portion 304*pc*. The stepped inner profile is defined by two profile diameters 304*d*1, 304*d*2, where the first profile diameter 304*d*1 is smaller than the second profile diameter 304*d*2. The insulative material 306 also conforms to the outer profile 302*p* of the inner conductor 302. The outer profile 302*p* is defined by profile diameters 302*d*1, 302*d*2 such that the first profile diameter 302*d*1 is smaller than the second profile diameter 302*d*2. The outer profile 302*p* of the inner conductor 302 also includes a radius profile portion 302*pc*, as shown particularly in FIG. 4.

Figure 5:
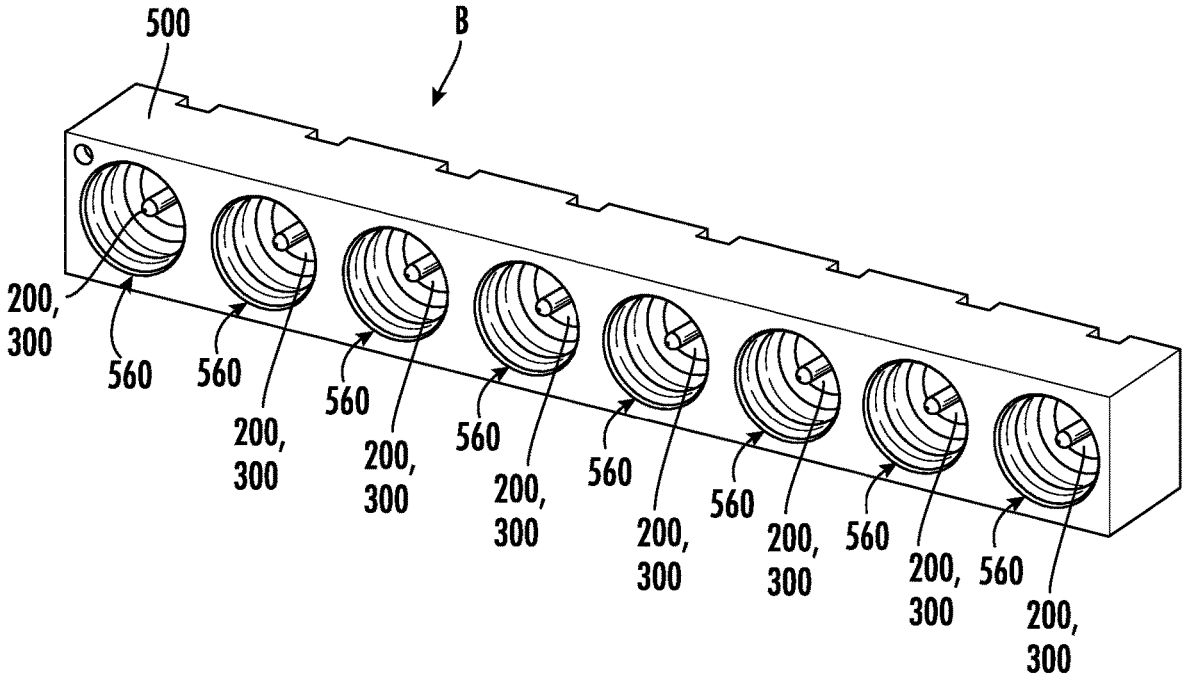
FIG. 5 is an isometric view of a multi-position block in accordance with embodiments disclosed herein.

FIG. 5 is an isometric view of a multi-position block B, which may include connectors 200, 300 or another type of connector having conductors with different profiles. The block B includes a block body 500 having plurality of bores 560 defined therein, in which the connectors 200, 300 may be inserted.

Figure 6:
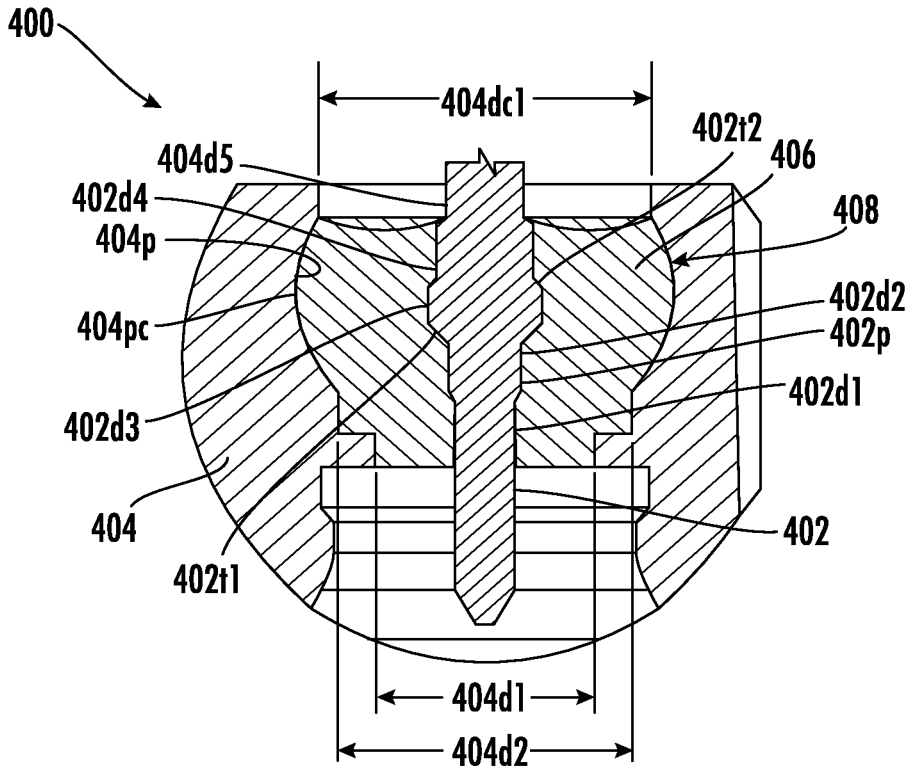
FIG. 6 is a cross-sectional view of another connector in accordance with embodiments disclosed herein.

FIG. 6 is a cross-sectional view of another exemplary connector 400, which may be manufactured using the processes/methods disclosed herein. The connector 400 includes an inner conductor 402, which is partially shown, an outer conductor 404, and an insulative material 406 formed between a volume 408 contained within the inner conductor 402 and the outer conductor 404. The insulative material 406 is formed within the volume 408 such that the insulative material conforms to the inner profile 404*p* of the outer conductor 304 and the outer profile 402*p* of the inner conductor 402. The inner profile 404*p* includes a radiused profile portion 404*pc*. The inner profile 404*p* is further defined by two profile diameters 404*d*1, 404*d*2, where the first profile diameter 404*d*1 is smaller than the second profile diameter 404*d*2. The inner profile 404*p* can additionally be defined by diameter 404*dc*1, which corresponds to the innermost diameter of the radius profile portion 404*pc*. The insulative material 406 also conforms to the outer profile 402*p* of the inner conductor 402. The outer profile 402*p* is defined by a plurality of profile diameters. In this exemplary inner conductor, the outer profile 402*p* is defined by at least profile diameters 402*d*1, 402*d*2, 402*d*3, 402*d*4, 402*d*. The outer profile 402*p* of the inner conductor 402 also includes tapered portions 402*t*1, 402*t*2.

Figure 7:
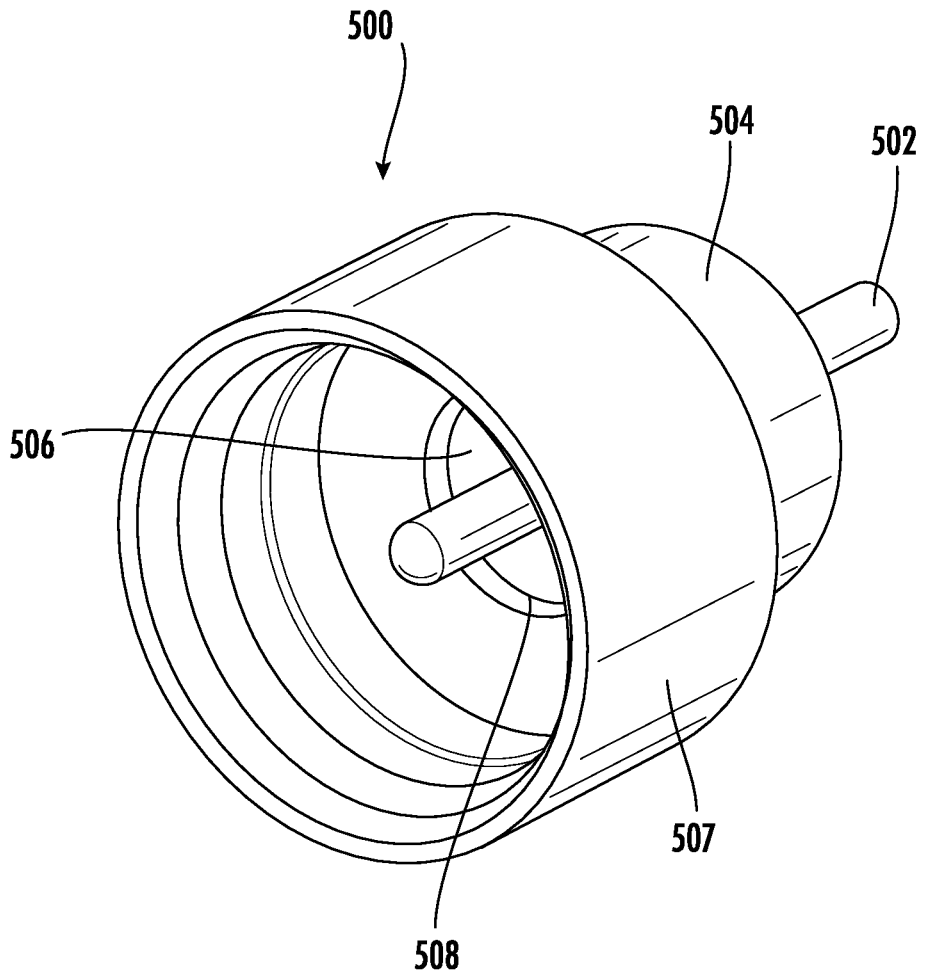
FIG. 7 is an isometric view of a single-position connector in accordance with embodiments disclosed herein.

FIG. 7 is an isometric view of another exemplary connector 500 that may be manufactured using the presently-disclosed processes/methods. The connector 500 includes an inner conductor 502, an outer conductor 504, and a insulative material 506, which has been formed in the volume 508 between the inner conductor 502 and the outer conductor 504. The insulative material 506 is formed within the volume 508 such that the insulative material conforms to an inner profile of the outer conductor 502 and an outer profile of the inner conductor 502. Coupled to or integral with the connector is a housing component 507, which can be used to facilitate connection to other components that may be assembled to the connector.

Figure 8:
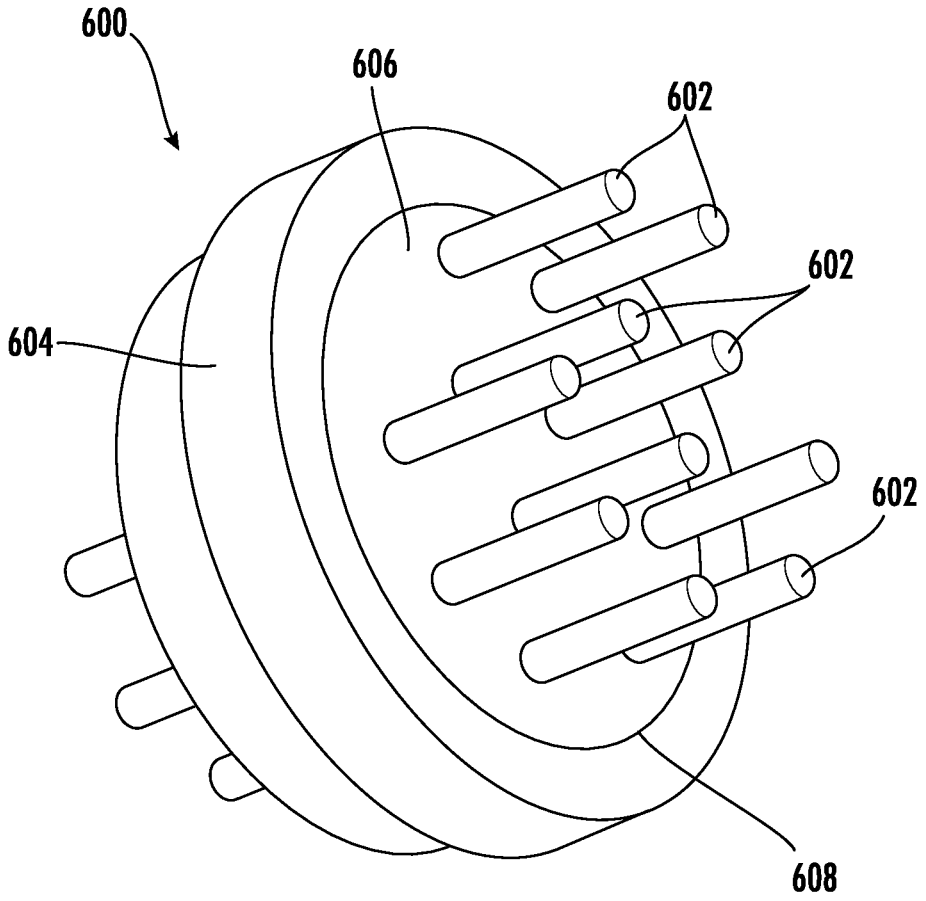
FIG. 8 is an isometric view of a multi-contact connector in accordance with embodiments disclosed herein.

FIG. 8 illustrates a multi-contact connector 600 that may be manufactured using the presently-disclosed processes/methods. The connector 600 includes a plurality of inner conductors 602, forming a multi-pin inner conductor, an outer conductor body 602, and a insulative material 606, which has been formed in the volume 608 between the inner conductor 502 and the outer conductor 504. Each inner conductor 602 is configured to extend through the insulative material 606.

Figure 9:
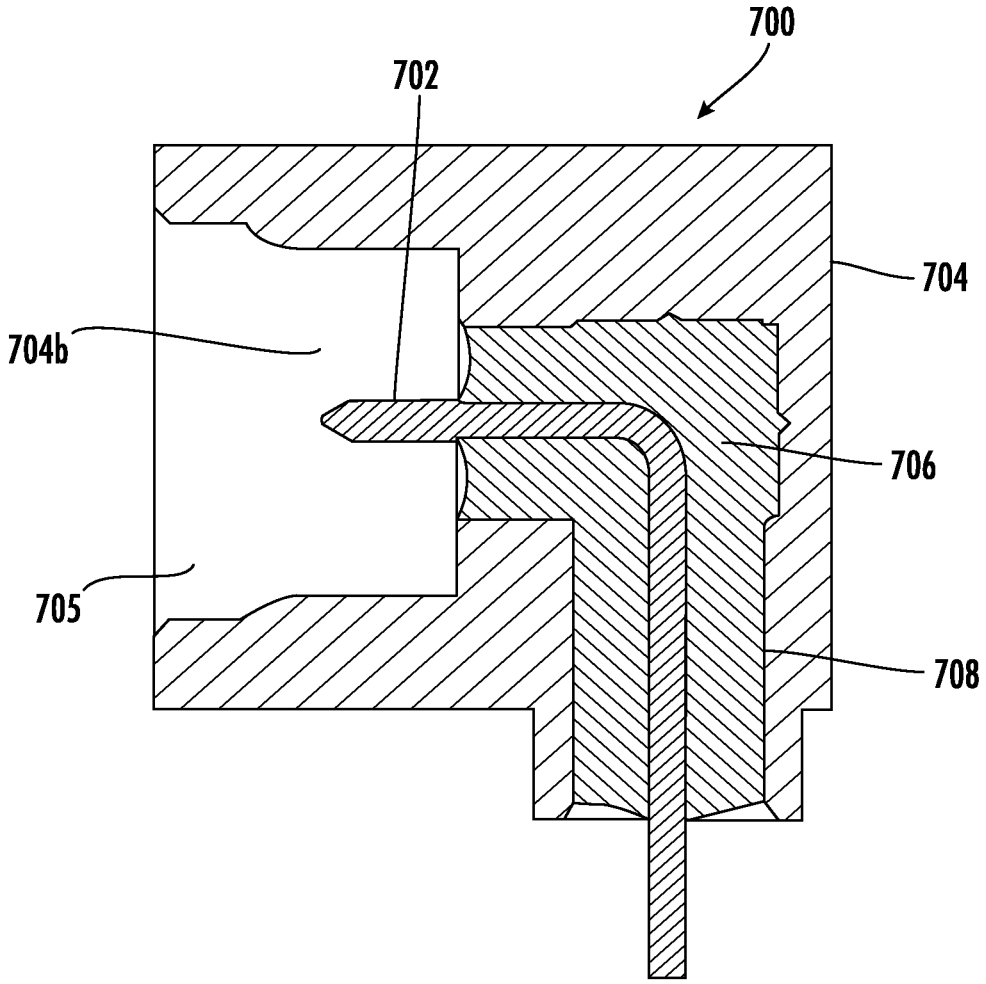
FIG. 9 is a cross-sectional view of an angled connector in accordance with embodiment disclosed herein.

FIG. 9 is a cross-sectional view of an angled connector 700 that may be manufactured using the presently-disclosed processes/methods. The connector 700 includes an inner conductor 702, which has been angularly formed. In this configuration, the inner conductor 702 has an included angle α, of about 90 degrees. The outer conductor 704 includes bores 705, 708. In this connector type, the insulative material is dispensed and then formed within a bore 708.

Figure 10:
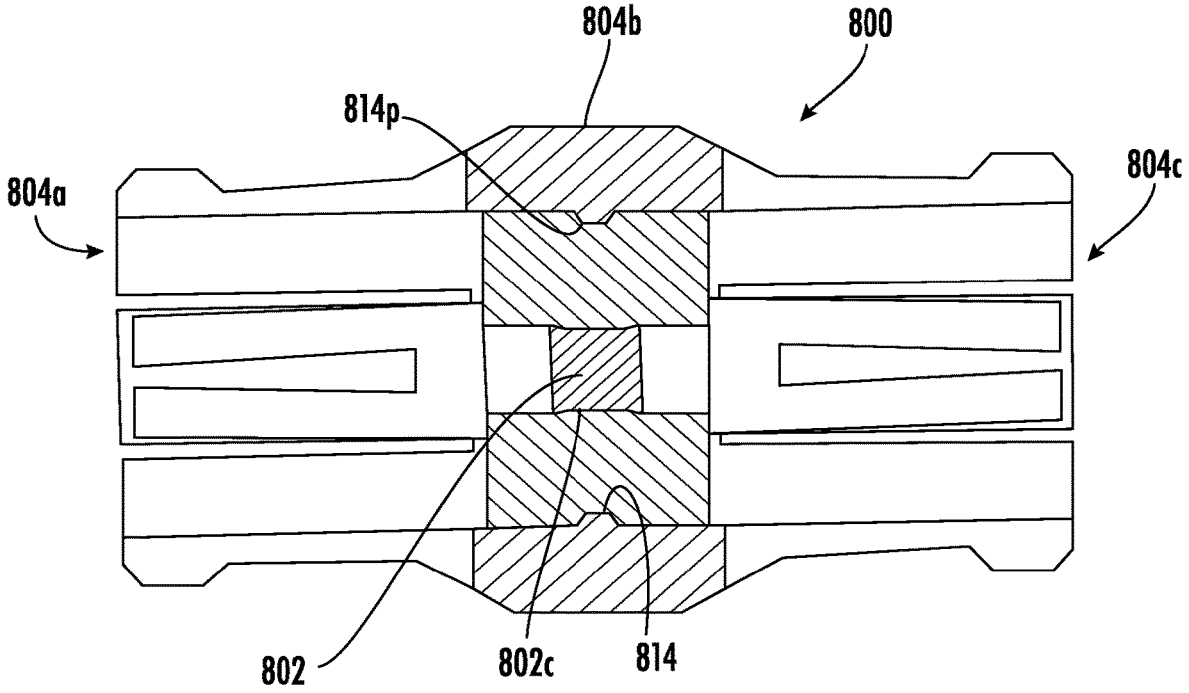
FIG. 10 is a cross-sectional view of a female connector with a socket in accordance with embodiments disclosed herein.

FIG. 10 illustrates a cross-sectional view of a female connector 800, which can manufactured using the materials and processes/methods disclosed herein. The connector 800 includes an inner conductor 802, an outer conductor 804, and an insulative material 806 formed in a volume between the inner conductor 802 and the outer conductor 804. The inner conductor 802 and the outer conductor 804 are positioned in the connector such that a socket is formed there. The inner conductor 802 has a curved profile 802*c* and the outer conductor 804 has a solid center area 804*b*, with an inwardly extending element 814, and a plurality of deflectable and flexible arms 804*a*, 804*c* on each end of the outer conductor. The insulative material 806 is formed between the inner conductor 802 and the outer conductor 804 such that the insulative material conforms to the curved profile 802*c* of the inner conductor and the profile 814*p* of the inwardly extending element 814.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the invention. Since modifications combinations, sub-combinations and variations of the disclosed embodiments incorporating the spirit and substance of the invention may occur to persons skilled in the art, the invention should be construed to include everything within the scope of the appended claims and their equivalents.

The invention claimed is:

1. A method of manufacturing an RF connector having an outer conductor and an inner conductor, the method comprising:

plating the outer conductor and the inner conductor of the RF connector with a corrosion-resistant metallic material;

positioning the inner conductor and the outer conductor such that a volume is formed between the inner conductor and the outer conductor;

dispensing a material comprising an epoxy phenol novolac based resin in the volume between the outer conductor and the inner conductor such that the material complements an inner profile of the outer conductor and an outer profile of the outer conductor;

heating the RF connector with the dispensed material to a temperature between about 150° C. to about 380° C.; and allowing the RF connector to cool.

2. The method of claim 1, wherein the method further comprises the step of positioning, prior to the step of dispensing of the material, the plated outer conductor and the plated inner conductor into a fixture assembly.

3. The method of claim 2, wherein the fixture assembly further comprises a plurality of fixture tiers.

4. The method of claim 2, wherein the fixture assembly comprises a plurality of fixture tiers and wherein at least one of the plurality of fixture tiers comprises polytetrafluorethylene.

5. The method of claim 1, wherein the RF connector is a coaxial connector and the inner conductor is a center conducting pin.

6. The method of claim 1, wherein the step of dispensing of the material comprises dispensing the material by an automated CNC dispensing system using a syringe.

7. The method of claim 1, wherein the step of dispensing the material comprises dispensing the material by an automated CNC dispensing system using jetting technology.

8. The method of claim 1, wherein heating the RF connector with the material comprises heating the RF connector by an oven that uses a nitrogen and partial-vacuum atmosphere.

9. The method of claim 1, wherein the inner conductor comprises a plurality of inner pins forming a multi-pin inner conductor.

10. The method of claim 1, wherein the material comprises a percentage of the epoxy phenol novolac based resin ranging from about 75% to about 100%.

11. The method of claim 1, wherein the material comprises a percentage of the epoxy phenol novolac based resin ranging from about 50% to about 100%.

12. The method claim 1, wherein the material comprises a percentage of the epoxy phenol novolac based resin ranging from about 25% to about 100%.

13. The method of claim 1, wherein the material comprises a percentage of the epoxy phenol novolac based resin ranging from about 15% to about 100%.

14. The method of claim 1, wherein the material comprises a percentage of the epoxy phenol novolac based resin ranging from about 5% to about 100%.

15. A method of manufacturing a connector having an outer conductor and an inner conductor, comprising:

plating the outer conductor and the inner conductor of the connector with a corrosion-resistant metallic material;

positioning the inner conductor and the outer conductor such that a volume is formed between the inner conductor and the outer conductor;

injecting a material comprising an epoxy phenol novolac based resin into the volume formed between the outer conductor and the inner conductor such that the material complements an inner profile of the outer conductor and an outer profile of the outer conductor, wherein defined in the outer conductor is at least one retention element;

substantially filling the at least one retention element with the epoxy phenol novolac based resin during injection of the material;

allowing air bubbles to escape from the outer conductor after the material is injected into the volume and the material is substantially filled into the at least one retention element;

heating the connector with the injected material to a temperature between about 150° C. to about 380° C.; and allowing the connector to cool.

16. The method of claim 15, wherein during the step of positioning of the inner conductor and the outer conductor includes:

positioning a portion of the inner conductor within a first non-metallic fixture tier and a second non-metallic fixture tier and positioning a portion of the outer conductor within the first non-metallic fixture tier and the second non-metallic fixture tier.

17. The method of claim 15, wherein the step of dispensing the material uses jetting technology.

18. The method of claim 15, wherein the step of dispensing the material uses syringe technology.

19. The method of claim 15, wherein the epoxy phenol novolac based resin comprises an imidazole catalyst.

20. The method of claim 19, wherein the imidazole catalyst is thermally cured.

* * * * *